United States Patent [19]

Sun et al.

[11] 4,295,858

[45] Oct. 20, 1981

[54] PROCESS FOR REMOVING SULFUR FROM COAL

[75] Inventors: Jui-Yuan Sun, South Holland; Emmett H. Burk, Jr., Glenwood; Jin S. Yoo, Flossmoor, all of Ill.; George P. Masologites, Columbus, N.C.

[73] Assignee: Atlantic Richfield Company, Philadelphia, Pa.

[21] Appl. No.: 126,248

[22] Filed: Mar. 3, 1980

Related U.S. Application Data

[63] Continuation-in-part of Ser. No. 944,452, Sep. 21, 1978, Pat. No. 4,249,910.

[51] Int. Cl.[3] ..... C10L 9/02

[52] U.S. Cl. ..... 44/1 SR; 44/24; 201/17

[58] Field of Search ..... 44/1 SR, 24; 201/17

[56] References Cited

U.S. PATENT DOCUMENTS 3,864,223 2/1975 Colwell ..... 44/1 SR 4,158,548 6/1979 Burk, Jr. et al. ..... 44/1 SR 4,224,038 9/1980 Masologites et al. ..... 44/1 SR

*Primary Examiner*—Carl F. Dees

*Attorney, Agent, or Firm*—John B. Goodman

[57] ABSTRACT

A process for reducing the sulfur and ash content of coal comprising the steps of: (1) contacting coal particles containing ash and iron pyrite mineral matter with a promoting amount of at least one conditioning agent, said conditioning agent having a ferrous component maintained at a pH of from about 5.5 to 11.0 and being capable of modifying or altering the existing surface characteristics of the pyrite under conditions to effectuate alteration of modification of at least a portion of the contained pyritic sulfur; (2) agglomerating the coal particles while said pyrite surfaces are altered or modified in an aqueous medium with hydrocarbon oil to form coal-hydrocarbon oil agglomerates; (3) separating said coal-hydrocarbon oil agglomerates from pyrite mineral matter and ash to recover coal-hydrocarbon oil agglomerates wherein the coal exhibits reduced sulfur and ash content.

19 Claims, No Drawings

PROCESS FOR REMOVING SULFUR FROM COAL

CROSS-REFERENCE TO RELATED APPLICATION

This application is a continuation-in-part of United States patent application Ser. No. 944,452, filed Sept. 21, 1978 now U.S. Pat. No. 4,249,910.

BACKGROUND OF THE INVENTION

1. Field of the Invention

The field of this invention relates to a process for reducing the sulfur content of coal.

2. Prior Art

The problem of air pollution due to the emission of sulfur oxides when sulfur-containing fuels are burned has received increasing attention in recent years. It is now widely recognized that sulfur oxides can be particularly harmful pollutants since they can combine with moisture to form corrosive acidic compositions which can be harmful and/or toxic to living organisms in very low concentrations.

Coal is an important fuel, and large amounts are burned in thermal generating plants primarily for conversion into electrical energy. One of the principal drawbacks in the use of coal as a fuel is that many coals contain amounts of sulfur which generate unacceptable amounts of sulfur oxides on burning. For example, coal combustion is by far the largest single source of sulfur dioxide pollution in the United States at present, and currently accounts for 60 to 65% of the total sulfur oxide emissions.

The sulfur content of coal, nearly all of which is emitted as sulfur oxides during combustion, is present in essentially two forms: inorganic, primarily metal pyrites, and organic sulfur. The inorganic sulfur compounds are mainly iron pyrites, with lesser amounts of other metal pyrites and metal sulfates. The organic sulfur may be in the form of thiols, disulfide, sulfides, and thiophenes chemically associated with the coal structure itself. Depending on the particular coal, the sulfur content can be primarily in the form of either inorganic sulfur or organic sulfur. Distribution between the two forms varies widely among various coals. For example, both Appalachian and Eastern interior coals are known to be rich in pyritic and organic sulfur. Generally, the pyritic sulfur represents from about 25% to 70% of the total sulfur content in these coals.

Heretofore, it was recognized that it would be highly desirable to remove (or at least lower) the sulfur content of coal prior to combustion. In this regard, a number of processes have been suggested for reducing the inorganic (pyritic) portion of the sulfur in coal.

For example, it is known that at least some pyritic sulfur can be physically removed from coal by grinding the coal, and subjecting the ground coal to froth flotation or washing processes. While such processes can desirably remove some pyritic sulfur and ash from the coal, these processes are not fully satisfactory because a significant portion of the pyritic sulfur is not removed. Attempts to increase the portion of pyritic sulfur removed have not been successful because these processes are not sufficiently selective. Because the process is not sufficiently selective, attempts to increase pyrite removal can result in a large portion of coal being discarded along with ash and pyrite. Organic sulfur cannot be physically removed from coal.

There have also been suggestions heretofore to chemically remove pyritic sulfur from coal. For example, U.S. Pat. No. 3,768,988 to Meyers, issued Oct. 30, 1973, discloses a process for reducing the pyritic sulfur content of coal involving exposing coal particles to a solution of ferric chloride. The patent suggests that in this process ferric chloride reacts with pyritic sulfur to provide free sulfur according to the following reaction process:

$$2FeCl_3 + FeS_2 \rightarrow 3FeCl_2 + S$$

While this process is of interest for removing pyritic sulfur, a disadvantage of the process is that the liberated sulfur solids must then be separated from the coal solids. Processes involving froth flotation, vaporization and solvent extraction are proposed to separate the sulfur solids. All of these proposals, however, inherently represent a second discrete process step with its attendant problems and cost which must be employed to remove the sulfur from coal. In addition, this process is notably deficient in that it cannot remove organic sulfur from coal.

In another approach, U.S. Pat. No. 3,824,084 to Dillon, issued July 16, 1974, discloses a process involving grinding coal containing pyritic sulfur in the presence of water to form a slurry, and then heating the slurry under pressure in the pressence of oxygen. The patent discloses that under these conditions, the pyritic sulfur (for example, $FeS_2$) can react to form ferrous sulfate and sulfuric acid which can further react to form ferric sulfate. The patent discloses that typical reaction equations for the process at the conditions specified are as follows:

$$FeS_2 + H_2O + 7/2O_2 \rightarrow FeSO_4 + H_2SO_4$$

$$2FeSO_4 + H_2SO_4 + 1/2O_2 \rightarrow Fe_2(SO_4)_3 + H_2O$$

These reaction equations indicate that in this particular process, the pyritic sulfur content continues to be associated with the iron as sulfate. Several factors detract from the desirability of this process. High temperatures and pressures are employed which can necessitate the use of expensive reaction vessels and processing plants of complex mechicanical design. Because high temperatures are employed, excessive amounts of energy can be expended in the process. In addition, the above oxidation process is not highly selective such that considerable amounts of coal itself can be oxidized. This is undesirable, of course, since the amount and/or heating value of the coal recovered from the process is decreased.

Heretofore, it was known that coal particles could be agglomerated with hydrocarbon oils. For example, U.S. Pat. No. 3,856,668 to Shubert, issued Dec. 24, 1974, and U.S. Pat. No. 3,665,066 to Capes et al, issued May 25, 1972, disclose processes for recovering coal fines by agglomerating the fine coal particles with oil. U.S. Pat. No. 3,268,071 to Puddington et al, issued Aug. 23, 1966, and U.S. Pat. No. 4,033,729, issued July 5, 1977, to Capes disclose processes involving agglomerating coal particles with oil in order to provide a separation of coal from ash. While these processes can provide some benefication of coal, improved ash and iron pyrite mineral matter removals would be desirable.

The above U.S. Pat. No. 4,033,729 to Capes et al relating to removing inorganic materials (ash) from coal significantly notes that iron pyrite mineral matter has proven difficult to remove because of its hydrophobic character. This disclosure confirms a long standing problem. The article "The Use of Oil in Cleaning Coal", Chemical and Metallurgical Engineering, Vol. 25, pages 182–188 (1921), discusses in detail cleaning coal by separating ash from coal in a process involving agitating coal-oil-water mixtures, but notes that iron pyrite is not readily removed in such a process.

In summary, while there is much prior art relating to processes for removing sulfur and ash from coal, there still exists a present need for a simple, efficient process for removing sulfur and ash from coal.

SUMMARY OF THE INVENTION

This invention provides a practical method for more effectively reducing the sulfur and ash content of coal. In summary, this invention involves a process for reducing the sulfur and ash content of coal comprising the steps of:

(1) contacting coal particles containing ash and iron pyrite mineral matter with a promoting amount of at least one conditioning agent, said conditioning agent having a ferrous component maintained at a pH of from about 5.5 to 11.0 and being capable of modifying or altering the existing surface characteristics of the pyrite under conditions to effectuate alteration of modification of at least a portion of the contained pyritic sulfur;

(2) agglomerating the coal particles while said pyrite surfaces are altered or modified in an aqueous medium with hydrocarbon oil to form coal-hydrocarbon oil agglomerates;

(3) separating said coal-hydrocarbon oil agglomerates from pyrite mineral matter and ash to recover coal-hydrocarbon oil agglomerates wherein the coal exhibits reduced sulfur and ash content.

It has been discovered that contacting sulfur-containing coal with the conditioning agents of this invention renders the pyrite more amenable to separation from the coal particles on agglomerating the coal particles with hydrocarbon oil. In addition, ash and total sulfur, including non-pyritic sulfur, removals can be enhanced by employing the conditioning agent in conjunction with agglomerating the coal particles with oil.

A notable advantage of the process is that significant sulfur reduction is obtained without significant loss of the coal substrate. The desirable result is that sulfur reduction is obtained without the amount and/or heating value of the coal being significantly decreased. Another advantage is that ambient conditions (i.e., normal temperatures and atmospheric pressure) can be employed such that process equipment and design is simplified, and less energy is required. Another advantage is that solid waste disposal problems can be reduced.

DETAILED DESCRIPTION OF THE INVENTION AND ITS PREFERRED EMBODIMENTS

In its broad aspect, this invention provides a method for reducing the sulfur content of coal by a process comprising the steps of:

(1) contacting coal particles containing ash and iron pyrite mineral matter with a promoting amount of at least one conditioning agent, said conditioning agent having a ferrous component maintained at a substantially neutral pH of from about 5.5 to 11.0 and being capable of modifying or altering the existing surface characteristics of the pyrite under conditions to effectuate alteration of modification of at least a portion of the contained pyritic sulfur;

(2) agglomerating the coal particles while said pyrite surfaces are altered or modified in an aqueous medium with hydrocarbon oil to form coal-hydrocarbon oil agglomerates;

(3) separating said coal-hydrocarbon oil agglomerates from pyrite mineral matter and ash to recover coal-hydrocarbon oil agglomerates wherein the coal exhibits reduced sulfur and ash content.

The novel process of this invention can substantially reduce the pyritic sulfur content of coal without substantial loss of the amount and/or heating value of the coal. In addition, the process by-products do not present substantial disposal problems.

Suitable coals which can be employed in the process of this invention include sub-bituminous, bituminous (high volatile, medium volatile, and low volatile), semi-anthracite, and anthracite. The rank of the feed coal, can vary and provide for pyritic sulfur removal by the process of this invention, although bituminous coals and higher ranked coals are preferred. Metallurgical coals, and coals which can be processed to metallurgical coals, containing sulfur in too high a content, can be particularly benefited by the process of this invention. In addition, coal refuse from wash plants which have been used to upgrade run-of-mine coal can also be used as a source of coal. Typically, the coal content of a refuse coal will be from about 25 to about 60% by weight of coal. Particularly preferred refuse coals are refuse from the washing of metallurgical coals.

In the process of this invention, coal particles containing iron pyrite mineral matter are contacted with a promoting amount of conditioning agent which can modify or alter the surface characteristics of these existing pyrite minerals such that pyrite becomes more amenable to separation from the coal upon agglomeration with hydrocarbon oil when compared to the pyritic minerals prior to conditioning.

It is an important aspect of this invention that the separation of the coal particles be effectuated during the time that the surface characteristics of the pyrite are altered or modified. This is particularly true when the conditions of contacting and/or chemical compounds present in the aqueous medium can cause realteration or remodification of the surface such as to deleteriously diminish the surface differences between pyrite mineral matter and the coal particles.

Conditioning agents found especially useful herein include ferrous iron compounds which exhibit some degree of solubility under the conditions of use. Among such conditioning agents are ferrous iron compounds which can hydrolyze in water, and the hydrolyzed forms of such ferrous iron compounds, preferably such forms which exist in effective amounts under the conditions of use. Proper pH and temperature conditions are necessary for some ferrous compounds to exist in an effective form. The ferrous iron compounds, both those having substantial solubility in water and those which are hydrolyzed or exist in hydrolyzed form under the given conditions of contacting (i.e., temperature and pH), modify or alter the existing surface characteristics of the pyrite, presumably increasing the hydrophilic nature of such surfaces. Preferred salts include, for example, ferrous sulfate, nitrate, chloride, hydroxide, and acetate. The ferrous iron conditioning agents of this invention are employed at a pH maintained within the range from about 5.5 to about 11.0, and preferably maintained within the range from about 6.0 to about 9.0, and more preferably within the range of from about 6.0 to 8.0. More preferably, the pH is substantially neutral. Substantially neutral conditions may be conveniently maintained by the inclusion of finely divided limestone, or a similar alkaline earth carbonate, in the system to react with any acidic components released from the coal during the processing operations. For example, one preferred conditioning agent comprises a suspension of finely divided calcium carbonate in an aqueous solution of ferrous sulfate. Carbonates of magnesium, strontium, and barium may also be employed.

One preferred processing mode involves the contacting of coal particles with the conditioning agent in a nitrogen atmosphere where the ferrous valence state of the conditioning agent can be better maintained. Subsequent to the contacting of the ferrous iron conditioning agent with the surfaces of the coal particles, exposure of the coal to normal atmosphereic conditions does not seem to affect the improvement realized in sulfur and ash removal.

The ferrous iron conditioning agent can be prepared in contact with the coal particles, or alternatively, can first be prepared apart from the contacting system for later treatment of the coal particles.

The coal particles employed in this invention can be provided by a variety of known processes, for example, grinding or crushing.

The particle size of the coal can vary over wide ranges. In general, the particles should be of a size to promote the removal of pyritic sulfur upon contacting with the conditioning agent in the aqueous medium. For instance, the coal may have an average particle size of one-eighth inch in diameter, or in some instances, as small as minus 400 mesh (Tyler Screen) or smaller. Depending on the occurrence and mode of distribution of pyritic sulfur in the coal, the rate of sulfur removal will vary. In general, if the pyrite particles are relatively large and are liberated readily upon grinding, the sulfur removal rate will be faster and the sulfur removal will be substantial. If the pyrite particles are small and associated with the coal through surface contact or encapsulation, then the degree of grinding will have to be increased in order to provide for liberation of the pyrite particles. In a preferred embodiment of this invention, the coal particles are reduced in size sufficient to effectuate liberation of sulfur and ash content and efficiency of conditioning. A very desirable particle size is often minus 24 mesh, or even minus 48 mesh. For coals having fine pyrite distributed through the coal matrix, particle size distribution wherein from about 50% to about 85%, preferably from about 60% to about 75%, by weight of the particles pass through minus 200 mesh provides a preferred feed wherein the maximum sizes are as set forth above.

The coal particles are preferably contacted with the conditioning agent in an aqueous medium by forming a mixture of the coal particles, conditioning agent, limestone and water. The mixture can be formed, for example, by grinding coal in the presence of limestone and water, and adding a suitable amount of conditioning agent. Another very suitable contacting method involves forming an aqueous mix of conditioning agent, water, limestone and coal and then crushing the coal and limestone with the aqueous mix of conditioning agent, for example, in a ball mill, to particles of a suitable size. Preferably, the aqueous medium contains from about 5% to about 50%, more preferably from about 5% to about 30%, by weight of the aqueous medium, of coal particles.

The coal particles are contacted for a period of time and under conditions of temperature and pressure sufficient to modify or alter the existing surface characteristics of the pyritic mineral matter sulfur in the coal such that it becomes more amenable to separation from the coal when the coal is oil agglomerated. The optimum time will depend upon the particular reaction condtions and the particular coal employed. Generally, a time period in the range of from about 1 minute to 2 hours or more, can be satisfactorily employed. Preferably, a time period of from 10 minutes to 1 hour is employed. Duiring this time, agitation can be desirably employed to enhance contacting. Known mechanical mixers, for example, can be employed.

An amount of conditioning agent is employed which is sufficient to promote the separation of pyrite and ash from coal. Generally, the proportion of conditioning agent, based on coal, will be within the range from about 0.01 to about 10 wt. %, desirably within the range from about 0.02 to about 2 wt. %, and often within the range from about 0.05 to about 0.25 wt. %.

Because one of the major results sought is an effective diminution in overall mineral matter content of the treated coal particles, the most preferred dosage of conditioning agent will depend upon the mineral matter content of the coal. Depending upon the type and source of the feed coal, the mineral matter content may vary widely and is generally within the range from about 5 to about 60 wt. %, and usually from about 10 to about 40 wt. %, based on the feed coal.

Preferably, the coal is contacted with the conditioning agent in aqueous medium. The contacting is carried out at a temperature such to modify or alter the pyrite surface characteristics. For example, temperatures in the range of about 0° C. to 100° C. can be employed, preferably from about 20° C. to about 35° C., i.e., ambient conditions. Temperatures above 100° C. can be employed, but are not generally preferred since a pressurized vessel would be acquired, and the ferrous ion is more easily oxidized to ferric. Temperatures in excess of 100° C. and pressures above atmospheric, generally pressures of from about 5 psig to about 500 psig, can be employed, however, if a processing advantage is obtained which justifies such conditions. For example, elevated temperatures may be useful if the viscosity and/or pour point of the agglomerating oil employed is too high at ambient temperatures to selectively agglomerate coal.

As stated above, the conditions of contacting are adjusted in order to effectuate the alteration or modification of the pyrite surface. During such time when the surface characteristics are altered or modified the coal particles are separated by agglomeration before significant deterioration of the surface characteristics occurs.

The process step whereby the sulfur-containing coal particles are contacted with conditioning agent in aqueous medium may be carried out in any conventional manner, e.g., batchwise, semi-batchwise or continuously. Since ambient temperatures can be used, conventional equipment will be suitable.

An amount of hydrocarbon oil necessary to form coal hydrocarbon oil agglomerates can be present during this conditioning step. Alternatively, and preferably, after the coal particles have been contacted with the conditioning agent in aqueous solution for a sufficient time, the coal particles are agglomerated with hydrocarbon oil.

Coal-hydrocarbon oil agglomerates are readily formed by agitating a mixture of water, hydrocarbon oil and coal particles. In the process of this invention, it is preferred to add the hydrocarbon oil to the aqueous medium of coal particles and conditioning agent, and agitate the resulting mixture to agglomerate the coal particles. If necessary, the water content of the mixture can be adjusted to provide for optimum agglomerating. Generally from about 30 to about 95 parts water, and more preferably 40 to about 90 parts water, based on the weight of coal, is most suitable for agglomeration. There should be sufficient hydrocarbon oil present to agglomerate the coal particles. The optimum amount of hydrocarbon oil will depend upon the particular hydrocarbon oil employed, the size and rank of the coal particles, and the size agglomerate desired. Generally, the amount of hydrocarbon oil contained in the oil-coal agglomerate will generally be from about 1% to about 20%, by weight. As stated above, it is an important part of this invention that the agglomeration and separation of the coal particles be effectuated before realteration or remodification of the iron pyrite mineral matter such that the hydrocarbon oil selectively agglomerates coal particles in preference to iron pyrite mineral matter.

Suitable hydrocarbon oils for forming the coal-oil agglomerates are derived from petroleum, shale oil, tar sand, and coal. Especially suitable hydrocarbon oils are light and heavy refined petroleum fractions such as light cycle oil, heavy cycle oil, heavy gas oil, clarified oil, kerosene, heavy vacuum gas oil, residual oil, coal tar and other coal derived oils. Mixtures of various hydrocarbon oils can be quite suitable; particularly when one of the materials is very viscous.

When it is desirable to utilize heavy oils and/or to reduce the overall amount of oil used in the agglomeration step, light hydrocarbon such as butane, pentane and/or hexane can be added alone or to heavier hydrocarbon oil during the agglomeration step. After separation of the coal particles from the mineral matter and pyritic sulfur, the lighter hydrocarbon can be stripped out by conventional means and recycled to the agglomeration step. If it is desired to form a hard coal product, e.g., a pellet, a binder, e.g., asphalt, may be added to the recovered coal particles to obtain such a product using conventional pelletizing equipment.

The hydrocarbon oils employed in this invention are hydrophobic and will preferentially wet hydrophobic material. It was recognized in this regard heretofore, that coal and the existing pyritic sulfur mineral matter can have similar surface characteristics which make separation of pyrite from coal difficult. While not wishing to be bound by any particular theory, it is theorized that the conditioning agents can alter or modify the pyrite by associating with the pyrite or alter the existing pyrite surface physically or chemically, to impart to the modified or altered pyrite surface more mineral-like surface characteristics. The chemical or physical altering of the surface can include the removal of surface constituents or impurities, thereby providing a means for separation of the pyrite from the coal upon agglomeration of the coal (and not the pyrite) with hydrocarbon oil.

It is a feature of this invention that these altered or modified pyrite mineral surface characteristics differ from the surface characteristics of the coal particles such that advantage can be taken of these differing surface characteristics, as for example, agglomeration with hydrocarbon oil to separate the conditioned pyrite and coal.

Whatever the exact mechanism may be, it has been discovered that treating coal particles with a conditioning agent in accordance with this invention alters or modified the surface characteristics of iron pyritic mineral matter. The result is that when the mixture of water, hydrocarbon oil and coal particles is agitated, the hydrocarbon oil preferentially wets (becomes associated with) the coal particles, as opposed to the altered iron pyrite and ash. These hydrocarbon wet coal particles collide with one another, under suitable agitation, forming coal-oil agglomerates substantially reduced in pyrite and ash. In general, the size of the coal-oil agglomerate is generally at least about 2 to 3 times the average size of the coal particles which make up the coal-oil agglomerates. Increasing amounts of oil can provide a substantial increase in agglomerate size.

As used herein "coal agglomerate" means an aggregate of a plurality of coal particles. These coal agglomerates can have a wide range of particle sizes. For example, agglomerates include small aggregates or flocs formed of several coal particles such that the aggregate is about 2 times, preferably from about 3 to 10 times, the average size of the coal particles which make up the agglomerate. (Such small agglomerates can be referred to as flocs or aggregates and are included within the term agglomerate.) Agglomerates can also include a large plurality of particles such that the agglomerate size is quite large. For example, agglomerates in the shape of balls having diameters of from about $\frac{1}{8}$ inch to about $\frac{1}{2}$ inch, or larger, can be formed.

Agitating the mixture of water, hydrocarbon oil and coal particles to form coal-oil agglomerates can be suitably accomplished using stirred tanks, ball mills or other apparatus.

The resulting coal-oil agglomerates can be separated from ash and pyrite using a variety of separation techniques.

Preferably a separation is effected by taking advantage of the size difference between coal-oil agglomerates and unagglomerated mineral matter including iron pyrite mineral matter. For example, the coal-oil agglomerates can be separated from the water and liberated ash and pyrite, etc., by filtering with bar sieves or screens, which predominately retain the coal-oil agglomerates, but pass water and unagglomerated mineral matter. The result is a physical separation of pyrite mineral matter and mineral matter from coal. When this technique is employed, coal-oil agglomerates of a size suitable for ready filtering must be formed.

Often it is desired to use small amounts of oil to form coal-oil agglomerates. Small amounts of oil, however, may provide small coal-oil agglomerates. Small coal-oil agglomerates (aggregates and flocs) can be more desirably separated by taking advantage of the different surface characteristics of the coal-oil agglomerates, and ash and conditioned pyrite, for example, employing flotation, skimming techniques or hydroclones. Examples of preferred separation processes employing small amounts of hydrocarbon oil are disclosed in copending patent applications Ser. Nos. 06/050,262; 06/050,263; and 06/050,263, all filed June 19, 1979 and commonly assigned. These patent applications are incorporated herein by reference.

Some ash or pyrite might have become occluded or associated with the coal-oil agglomerates. For this reason, it is often preferable to wash the recovered coal-oil agglomerates with water, depending on the effectiveness of this step, to re-slurry them in water, and then subject them to additional agitation. The result is that the recovered coal-oil agglomerates can break, liberating additional ash and pyrite, and re-agglomerate. Employing this technique, additional reductions of ash and pyrite can be obtained. With some coals this can be preferred.

Ball milling, rod milling or the equivalent thereof can be particularly effective since these agitation methods provide a kneading action which can continually break and change the surface of the coal-hydrocarbon oil agglomerate exposing and liberating additional ash and pyrite materials from the conditioned coal. These methods are particularly useful when forming coal-hydrocarbon oil agglomerates of high oil content, for example, from about 25% to about 50% oil, by weight of the coal-hydrocarbon oil agglomerate.

The coal-hydrocarbon oil agglomerates provided by the process of the invention are coal-hydrocarbon oil agglomerates wherein the coal portion is reduced in sulfur content. The weight percent of iron pyrite in the coal portion is reduced at least by 50%, and often 70% to 90% or more, for example, 99%. The coal-hydrocarbon oil agglomerates are themselves an excellent low sulfur, reduced ash fuel and can be used as such.

If desired, the oil can be removed from these coal-hydrocarbon oil agglomerates to provide coal particles reduced in ash and sulfur content. A variety of methods can be employed to remove the hydrocarbon oil from the coal-hydrocarbon oil agglomerates. For example, agglomerates can be washed with an organic solvent such as hexane or toluene, in which the hydrocarbon oil is soluble. The resulting solution is then separated from the coal particles.

The resulting coal product has a substantially reduced pyritic sulfur content and can exhibit a diminished non-pyritic sulfur content. For example, in some coals up to 30%, by weight, of non-pyritic sulfur (i.e., sulfate, sulfur and/or organic sulfur) is removed. In addition, the coal product can be reduced in ash. The coal can be dried prior to use or storage.

In the process of this invention, ash and pyrite are rejected to the aqueous phase. This aqueous phase, containing rejected ash and pyrite, is a by-product of the process of separating coal-hydrocarbon oil agglomerates from the aqueous containing ash and pyrite mineral matter. Typically, disposal of ash and pyrite by-products present substantial environmental problems. It is known that pyrite oxidizes readily in the presence of water to form sulfuric acid. It is also known that fine ash particles are difficult to separate from water. In addition, physical coal cleaning processes generate unrecovered coal fines which create additional disposal problems.

Another aspect of this invention is that the conditioning agents employed herein can modify both the ash and pyrite such that the pyrite may be less susceptible to oxidation and the ash and pyrite separate from water more quickly. The result is that disposal problems associated with these materials are substantially reduced, i.e., ease of dewatering in the case of separation. In addition, since substantially all, i.e., more than 90% by weight, of the organic coal treated in the process of this invention can be recovered, unrecovered coal (i.e., coal fines) do not present disposal problems, such as spontaneous combustion which can occur in refuse piles.

It is another aspect of this invention that coal recovered from the process exhibits substantially improved fouling and slagging properties. Thus, the process can provide for improved removals of those inorganic constituents which cause high fouling and slagging in combustion furnaces.

The following examples are provided to better illustrate the invention, without limitation, by presenting several specific embodiments of the process of the invention.

Examples I–VII, presented in Table 1, are based on Illinois No. 5 coal, sampled from the Blackhawk mine.

EXAMPLE I

Base data are presented on a run of mine core section, ground to 4-mesh particle size.

EXAMPLE II

A portion of coal from Example I was ground in a ball mill with water (30 wt. % coal in slurry) for 30 minutes. The ball-milled coal was separated, dried and classified to provide an 80-mesh sample.

EXAMPLES III and IV

The coal treatment of Example II was repeated on two separate portions of coal from Example I, each portion designated Example III and IV, respectively.

EXAMPLE V

A portion of the 80-mesh coal from Example II was slurried with water and agglomerated with the addition of 15 wt. % heavy virgin gas oil (HVGO), based on coal. The coal-hydrocarbon oil agglomerate was separated from the aqueous phase in a sieve bend and washed with pentane to yield a treated coal sample.

EXAMPLE VI

A portion of the 80-mesh coal from Example III was slurried with an aqueous phase containing ferrous sulfate and powdered limestone (1.2 wt. % Fe, based on coal) and agglomerated at 60° C. with the addition of 10 wt. % HVGO, based on coal. The coal-oil agglomerate was separated from the aqueous phase in a sieve bend and washed with pentane to yield a treated coal sample.

EXAMPLE VII

A portion of the 80-mesh coal from Example IV was slurried with an aqueous phase containing ferrous hydroxide and powdered limestone (0.2 wt. % Fe, based on coal) and agglomerated at 60° C. with the addition of 7.5 wt. % HVGO, based on coal. The coal-hydrocarbon oil agglomerate was separated from the aqueous phase in a sieve bend and washed with pentane to yield a treated coal sample.

TABLE 1

Sulfur and Ash Removal - Illinois No. 5 Coal

| | | Sulfur, wt. % * | | | |
|---|---|---|---|---|---|
| Example | Ash, wt. % | Total | Sulfate | Pyrite | Organic |
| I | 19.5 | 6.91 | 0.31 | 4.27 | 2.32 |
| II | 12.8 | 3.49 | 0.04 | 2.08 | 1.37 |
| III | 14.1 | 4.14 | 0.07 | 2.57 | 1.50 |
| IV | 12.1 | 3.85 | 0.07 | 2.29 | 1.49 |
| V | 5.86 | 2.74 | 0.04 | 1.54 | 1.16 |
| VI | 4.87 | 2.04 | 0.03 | 0.97 | 1.04 |
| VII | 4.68 | 2.20 | 0.01 | 1.05 | 1.15 |

* Dry, ash-free basis

What is claimed is:

1. A process for reducing the sulfur and ash content of coal comprising the steps of:

(1) contacting coal particles containing ash and iron pyrite mineral matter with a promoting amount of at least one conditioning agent, said conditioning agent having a ferrous component maintained at a pH of from about 5.5 to 11.0 and being capable of modifying or altering the existing surface characteristics of the pyrite under conditions to effectuate alteration of modification of at least a portion of the contained pyritic sulfur;

(2) agglomerating the coal particles while said pyrite surfaces are altered or modified in an aqueous medium with hydrocarbon oil to form coal-hydrocarbon oil agglomerates;

(3) separating said coal-hydrocarbon oil agglomerates from pyrite mineral matter and ash to recover coal-hydrocarbon oil agglomerates wherein the coal exhibits reduced sulfur and ash content.

2. The process of claim 1 wherein the conditioning agent is prepared externally and added to the coal particles.

3. The process of claim 1 wherein the conditioning agent is prepared in water.

4. The process of claim 1 wherein the concentration of the ferrous component is within the range from about 0.02 wt. % to about 2.0 wt. %, based on coal.

5. The process of claim 4 wherein the concentration of the ferrous component is within the range from about 0.05 wt. % to about 0.25 wt. %, based on coal.

6. The process of claim 1 wherein the conditioning agent comprises an aqueous solution of a ferrous salt maintained at a pH value within the range from about 5.5 to about 9.0.

7. The process of claim 6 wherein a finely divided alkaline earth carbonate is suspended in the aqueous solution.

8. The process of claim 7 wherein the alkaline earth carbonate is calcium carbonate.

9. The process of claim 6 wherein the pH value is maintained within the range from about 6 to about 8.

10. The process of claim 1 wherein the conditioning agent comprises an aqueous solution of ferrous sulfate having finely divided calcium carbonate suspended therein.

11. The process of claim 1 wherein the coal particles are contacted with the conditioning agent at a temperature in the range from about 0° C. to about 100° C.

12. The process of claim 11 wherein the coal particles are contacted with the conditioning agent at a temperature in the range from about 20° C. to about 35° C.

13. The process of claim 1 wherein the coal particles are contacted with the conditioning agent for a period of from about 1 minute to about 2 hours.

14. The process of claim 13 wherein the coal particles are contacted with the conditioning agent for a period of from about 10 minutes to about 1 hour.

15. The process of claim 1 wherein the hydrocarbon oil is derived from petroleum, shale oil, tar sand, and coal.

16. The process of claim 1 wherein the hydrocarbon oil is selected from the group consisting of light cycle oil, heavy cycle oil, heavy gas oil, clarified oil, kerosene, heavy vacuum gas oil, residual oil, coal tar and mixtures thereof.

17. The process of claim 15 wherein the hydrocarbon oil agglomerates contain from about 1% to about 25% oil.

18. The process of claim 17 wherein the hydrocarbon oil agglomerates contain from about 5% to about 15% oil.

19. The process of claim 1 wherein the coal is selected from the group consisting of bituminous coal and higher ranked coal.

* * * * *